United States Patent [19]

Wolf

[11] Patent Number: 4,941,259

[45] Date of Patent: Jul. 17, 1990

[54] DRY SHAVING APPARATUS WITH A SHORT-HAIR CUTTER AND A SLIDABLE LONGHAIR TRIMMER

[75] Inventor: Jürgen Wolf, Kriftel, Fed. Rep. of Germany

[73] Assignee: Braun Aktiengesellschaft, Kronberg, Fed. Rep. of Germany

[21] Appl. No.: 233,339

[22] Filed: Aug. 17, 1988

[30] Foreign Application Priority Data

Sep. 2, 1987 [DE] Fed. Rep. of Germany ..... 3729257

[51] Int. Cl.[5] ..... B26B 19/10

[52] U.S. Cl. ..... 30/34.1; 30/43.1; 30/43.92; 30/45; 30/346.51

[58] Field of Search ..... 30/34.1, 43.92, 43.1, 30/45, 346.51, 195, 346.5

[56] References Cited

U.S. PATENT DOCUMENTS 4,283,848 8/1981 Messinger ..... 30/34.1

4,380,869 4/1983 Shirakawa et al. ..... 30/34.1

4,408,392 10/1983 Naimer ..... 30/34.1

FOREIGN PATENT DOCUMENTS 2122944 12/1971 Fed. Rep. of Germany .

*Primary Examiner*—Frank T. Yost

*Assistant Examiner*—Y. Lin

*Attorney, Agent, or Firm*—Fish & Richardson

[57] ABSTRACT

The invention is directed to a dry shaving apparatus with a short-hair cutter, a manually operated first switch slide slidably arranged on the housing for turning on and off the associated second switch slide carrying a long-hair trimmer which is adapted to be moved from a position of rest into an operating position lying in the area of the short-hair cutter by means of the second switch slide as well as two interengageable gear arrangements and which in the operating position is coupled to the drive of the dry shaving apparatus.

21 Claims, 5 Drawing Sheets

DRY SHAVING APPARATUS WITH A SHORT-HAIR CUTTER AND A SLIDABLE LONGHAIR TRIMMER

This invention relates to a dry shaving apparatus with a short-hair cutter, a manually operated first switch slide slidably arranged on the housing for turning the dry shaving apparatus on and off, and with a second switch slide operatively associated with the first switch slide and carrying a long-hair trimmer which is movable by means of the second switch slide from a position of rest into an operating position lying in the area of the short-hair cutter and which in the operating position is coupled to the drive of the dry shaving apparatus.

From DE-C2 843 947 a dry shaving apparatus of the type initially referred to is known in which the switch slides slidable in the same direction are relatively arranged and designed such that upon reaching the ON position the first switch slide abuts the second switch slide carrying the long-hair trimmer and, on further displacement, moves the second switch slide into an operating position lying in the area of the short-hair cutter. Locking means are provided on the first switch slide to serve a locking function in the ON and OFF position and in the operating position of the second switch slide. Further locking means provided between the first and the second switch slide serve to return the second switch slide into the initial position, including a suitable release function to return the first switch slide to the OFF position. The total length of travel to be covered by the first switch slide is thus composed of the travel required to reach the ON position plus the additional travel required to bring the second switch slide into the operating position.

From AT-B 368 057 a long-hair trimmer for a shaving apparatus is known in which the long-hair trimmer which is embedded in the shaver housing is pivotally connected with a switch slide so that a pivot motion is superimposable upon the sliding motion of the long-hair trimmer. The long-hair trimmer is slidably mounted on a rocking member which in the position of non-use of the long-hair trimmer serves as a cover for the long-hair trimmer embedded in the shaver housing. Between the switch slide and the cutter carrier of the long-hair trimmer, a connection comprised of a control cable is provided which has its one end fixedly secured to the shaver housing while its other end, after being deflected by 180° , is fixedly secured to the long-hair trimmer, with the cable deflecting function being performed by a semicircular guide provided in the switch slide. Coupling the switch slide to the long-hair trimmer as provided in this known device results directly in both a sliding and a pivot motion of the long-hair trimmer into the desired operating position when the switch slide is actuated. This shaver in which a long-hair trimmer is embedded in the housing in the OFF position necessitates an additional ON/OFF switch to be able to shave by means of the short-hair cutter provided in the shaving head.

It is an object of the present invention to provide a switch control means for a device of the type initially referred to which, while affording a minimum possible length of travel of a manually operated switch slide, ensures first and ON and OFF position of the device and subsequently an operating position of a switch slide carrying a long-hair trimmer, using a sliding travel extending beyond the contact travel of the manually operated switch slide in order to bring the long-hair trimmer into an operating position lying in the area of the short-hair cutter.

According to the invention, this object is accomplished in a device of the type initially referred to in that a gear arrangement each is provided for the contact travel of the first switch slide and for the contact travel of the second switch slide, which gear arrangements are interengageable in the course of the contact travel of the first switch slide.

It is an advantage of the present invention that the shaving apparatus requires the operation of only one switch slide to turn the device on and off, for example, in order to be able to use only the short-hair cutter provided, and that, by further displacement of this switch slide beyond the ON position, the second switch slide carrying a long-hair trimmer is moved into an operating position lying in the area of the short-hair cutter by means of the gear arrangements provided, with the gear arrangements, following or by engagement of the one gear arrangement with the other gear arrangement, combining to form a gearing by means of which the contact travel of the manually operated first switch slide is transmitted in order to bring the second switch slide carrying the long-hair trimmer into the operating position provided. As the first switch slide is slid back, the second switch slide with its long-hair trimmer is returned to the OFF position via the gear arrangements, without the inconvenience of an idle movement.

The mechanical structure of this control means is very simple, requiring, on the basis of a preferred symmetrical arrangement of the gearing in the area of the side walls of the housing, merely two toothed pinions as separate components, whilst the racks which are further required may be directly formed on the switch slides and on the housing parts in the manufacturing process of the other shaver components.

In an embodiment of the invention, the one gear arrangement comprises at least one rack provided on the second switch slide and at least one pinion mounted on the first switch slide and permanently engaged with the rack.

Preferably, the second gear arrangement is comprised of at least one rack provided on the housing.

The housing preferably includes stops for limiting the contact travel of the first switch slide.

The first switch slide preferably includes stops for limiting the contact travel.

In an embodiment of the invention, the stop on the first switch slide is in abutment with the stop on the housing when the first switch slide is in the OFF position.

In an embodiment of the invention, the second switch slide is held in the OFF position against at least one stop provided on the housing by means of a pivotally arranged spring. One of the advantages of this spring is that it provides for rattle-free operative engagement between the second switch slide carrying a long-hair trimmer and the manually operated first switch slide both in the OFF position and in operation.

Preferably, the second switch slide includes at least one stop for abutment with the first switch slide.

In an embodiment of the invention, the first gear arrangement is adapted to engage with the second gear arrangement by means of displacement of the first switch slide picking up the second switch slide via the stop and by engagement of the pinion provided on the first switch slide with the teeth of the rack. Engagement of the first gear arrangement with the second gear arrangement is accomplished according to the invention in that by abutment of a stop of the first switch slide with the stop of the second switch slide the pinion is adapted to be stopped.

The teeth of the pinions and racks, including their relative arrangement, are positioned such that the stopped pinion is adapted to thread into the racks. In an embodiment of the invention, the gear arrangements which are in mesh via the pinion and the racks reverse the direction of rotation of the pinion by means of which the further sliding travel of the second switch slide can be doubled relative to the contact travel of the first switch slide.

Preferably, the sliding travel of the second switch slide is adapted to be limited by at least one of the stops provided on the housing.

It is a further advantage of the spring that, following abutment of the stop of the first switch slide with the stop of the second switch slide, the pivotally mounted spring, in overriding dead center, is adapted to be moved by the first switch slide via the second switch slide into a pivot position in which the second switch slide is movable into an operating position by means of releasing the spring which has become tensioned in the course of the pivot motion.

The spring is preferably a leg spring.

In an embodiment of the invention, the spring is mounted between two bolts, with the one bolt being provided on the second switch slide and the other bolt on a one-armed lever, and the transmission lever has its one end carried in a coulisse provided on the housing and its other end in a sliding bearing provided in the second switch slide by means of bearing bolts provided at the lever ends.

A particular advantage of mounting the spring on the transmission lever and on the second switch slide in this manner, in conjunction with the mounting of the transmission lever in the coulisse such as to allow a sliding motion, is that the spring forces are not transmitted to the housing or its side wall. In consequence, the second switch slide is movable relative to the housing into the operating position and back again free from lateral forces. An angular tilt of the second switch slide relative to the housing is thereby avoided.

Preferably, the switch positions of the first switch slide are determined by engageable locking means provided on the first switch slide as well as on the housing. The locking means on the first switch slide is preferably at least one switch coulisse including three notches. The locking means on the housing is preferably at least one resilient arm including a locking cam.

Further advantages and details of the invention will become apparent from the subsequent description and the drawings illustrating some preferred embodiments. In the drawings, FIG. 1 is a perspective view of the front side of a shaving apparatus having two switch slides;

Figure 5:
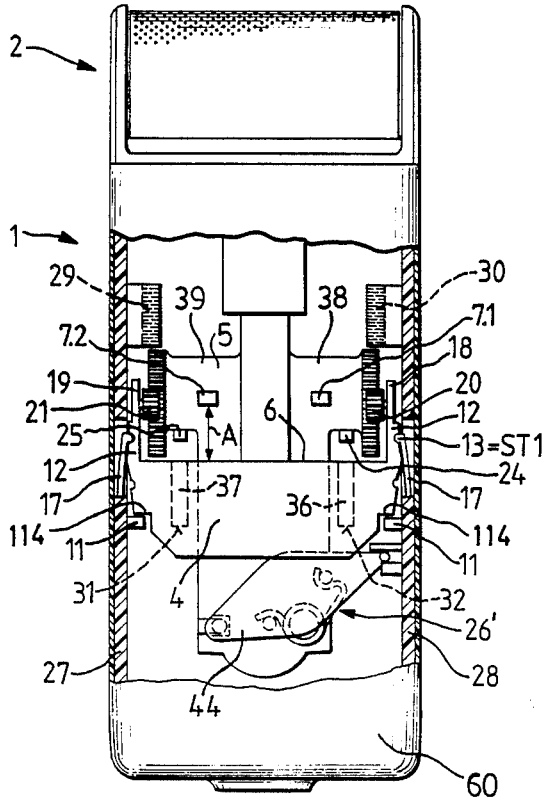
FIG. 5 is a view of the rear side of a shaving apparatus with the housing partly broken away and showing the gear arrangements and stops provided in the housing.
Figure 5A:
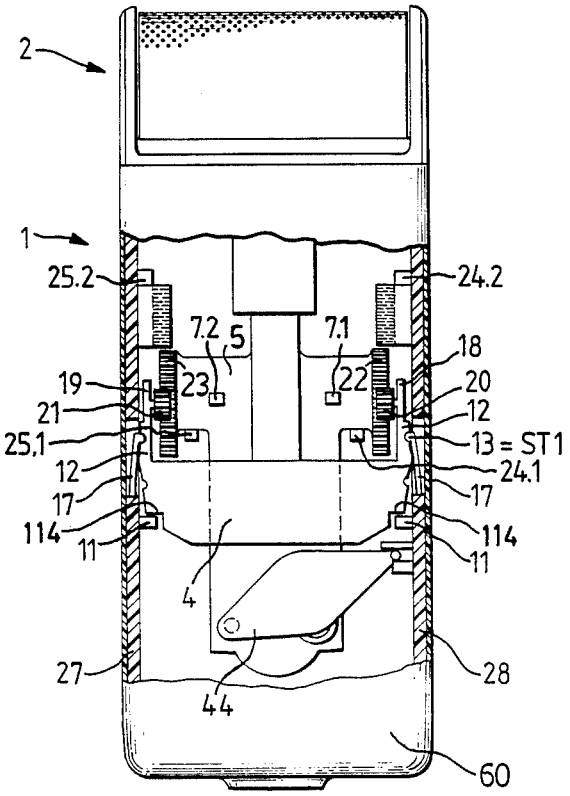
Figure 6:
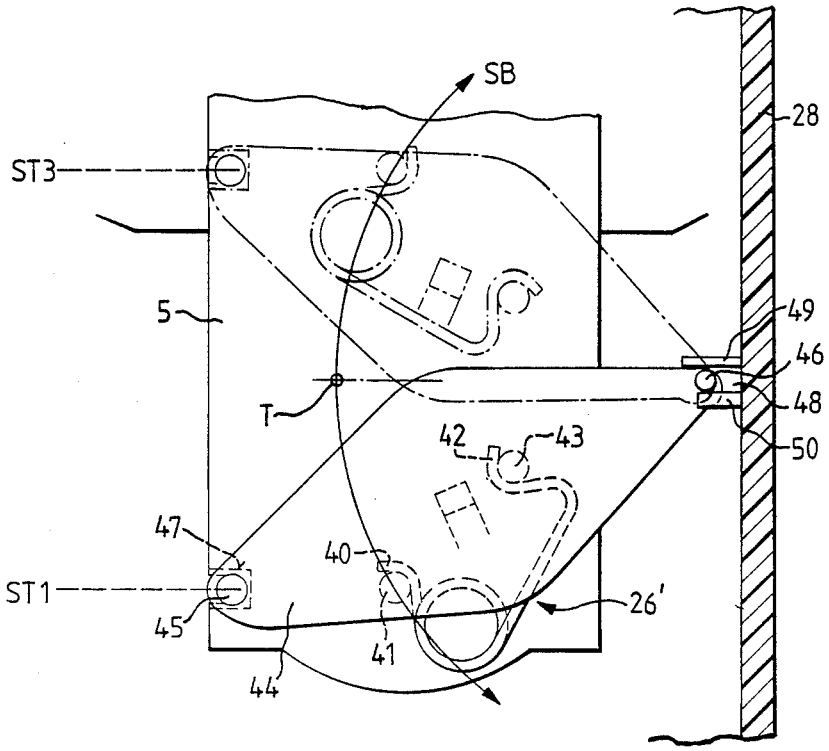

FIG. 5*a* is a view of the rear side of a shaving apparatus with the housing partly broken away and showing the gear arrangements and stops provided in the housing; and FIG. 6 is a view showing the configuration and pivot positions of a pivotally mounted spring acting on the switch slide carrying a long-hair trimmer.

Figure 1:
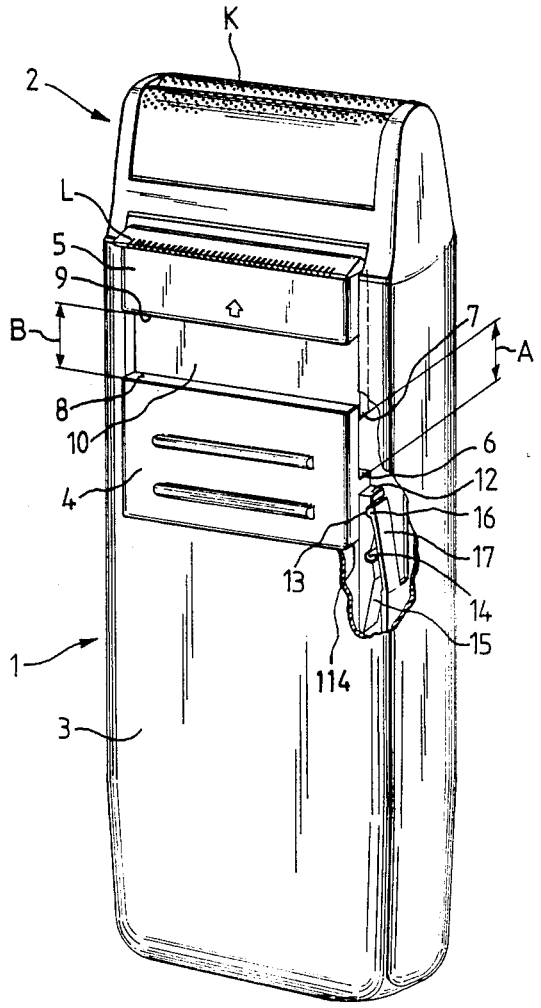

Referring now to FIG. 1, there is shown a dry shaving apparatus with a housing 1, a shaving head 2 carrying a short-hair cutter K, as well as with a first switch slide 4 and a second switch slide 5 slidably mounted on the front panel 3 of the housing in the same direction. The shaving head 2 may be detachable from the housing 1 in the known manner or it may be pivotally mounted about a pivot axis. The switch slides 4 and 5 are stepped. The stepped shoulders are relatively arranged such as to partly overlap each other. The respective terminal steps of the stepped shoulders provide stops 6, 7, 8, 9 relatively spaced at predetermined distances A and B when the switch slides 4 and 5 are in the OFF position.

In all embodiments, the function of the stops 6 and 7 may be served by the stops 8 and 9, provided that the distance B which is slightly larger than distance A is provided between the stops 8 and 9 and that the distance A is provided between the stops 6 and 7.

In the subsequent description of FIGS. 1 to 7, reference will be had to the stops 6 and 7 relatively spaced at distance A.

The switch slides 4 and 5 are slidably arranged in a U-shaped recess 10 provided on the front panel 3 of the housing 1. The side wall of the recess 10 extending transversely to the sliding direction of the switch slides provides a stop 11 for the switch slide 4 which is in the OFF position ST1 when its end serving as stop 114 is in abutment with the stop 11. The switch slide includes two switch coulisses 12 having notches 13, 14, 15. Formed on the housing 1 are two resilient arms 17 having locking cams 16 to hold the switch slide 4 in the individual switch positions by the locking cams 16 engaging the notches 13, 14, 15. By means of a broken away portion in the housing 1 of FIG. 1, it is possible to view one of the switch coulisses 12 as well as one of the resilient arms 17. At its end close to the shaving head 2, the switch slide 5 carries a long-hair trimmer L which in the operating position is coupled to the electric drive, not shown, of the shaving apparatus.

Figure 4:
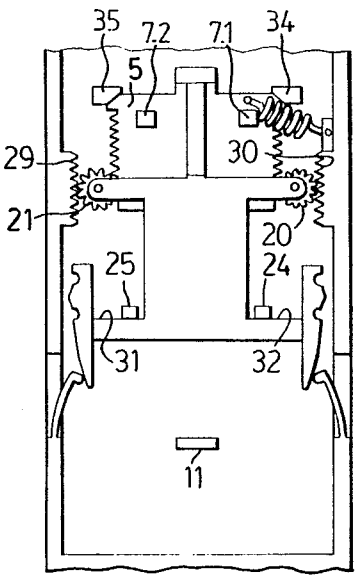
FIGS. 2 to 4 are longitudinal sectional views of a shaving apparatus showing the two gear arrangements in schematic representation.
Figure 3:
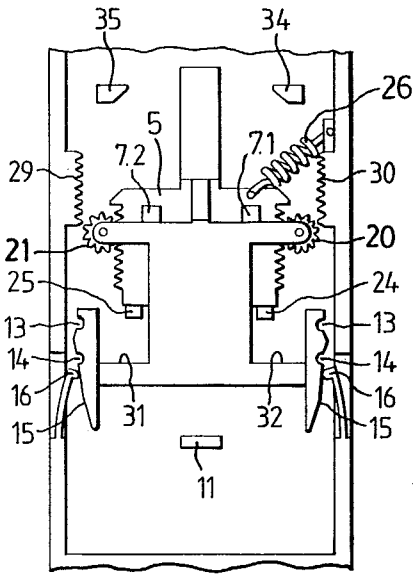
Figure 2:
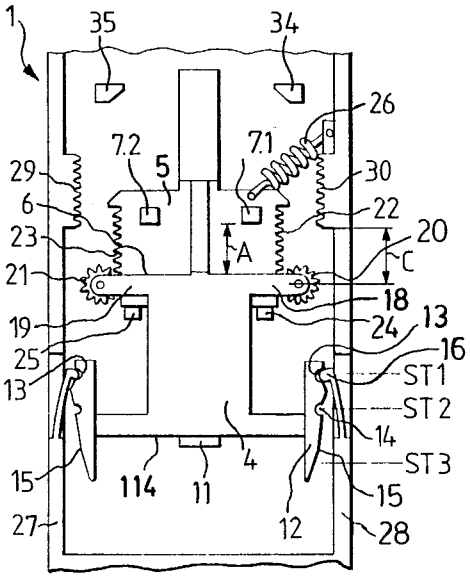

FIGS. 2 to 4 show a longitudinal section through a shaving apparatus, with the control means of the two gear arrangements being illustrated schematically. In FIG. 2, the switch slide 4 is in the OFF position ST1 which is determined by engagement of the locking cams 16 into the notches 13 of the switch coulisses 12 and by abutment of the stop 114 of the switch slide 4 with the stop 11 provided on the housing 1. At the end of the switch slide 4 remote from the stop 114, two arms 18 and 19 are provided, each carrying rotatably a respective pinion 20 and 21. Over the entire length of contact travel of the switch slide 4, the pinions 20 and 21 are in permanent engagement with the racks 22 and 23, respectively, of this first gear arrangement provided on the switch slide 5. In the switch position ST1, the pinions 20 and 21 are in engagement with the lower end of the racks 22 and 23 extending in the sliding direction of the switch slides 4 and 5. In the OFF position ST1, the switch slide 5 rests against two stops 24 and 25 provided on the housing 1, such abutment being ensured by means of a spring 26 pivotally mounted on the housing 1 and acting on the switch slide 5. The switch slide 5 includes two stops 7.1 and 7.2 which, providing a common stop 7 as illustrated and described with reference to FIG. 1, are at a predetermined distance A relative to the stop 6 which, according to FIG. 2, is formed by the upper end wall of the switch slide 4.

As second gear arrangement, racks 29 and 30 extending in the sliding direction of the switch slides 4 and 5 are provided on the side walls 27 and 28, respectively, of the housing 1. In the switch position ST1 in which the stop 114 of the switch slide 4 is in abutment with the stop 11, the switch slide 5 is in abutment with the stops 24 and 25, and the stop 6 is at the predetermined relative distance A to the stops 7.1 and 7.2, the lower ends of the racks 29 and 30 on the side walls 27 and 28 of the housing 1 are at a distance C to the axes of rotation of the pinions 20 and 21. Distance C is slightly larger than distance A in order to ensure that following abutment of the stop 6 of the switch slide 4 with the stops 7.1 and 7.2 of the switch slide 5 as shown in FIG. 3, the pinions 20 and 21 are short of gearing with the respective rack 29 and 30.

By means of displacement of the switch slide 4 into the switch position ST2 which is determined by the locking cams 16 falling into the notches 14 of the switch coulisses 12 provided on the switch slide 4, the drive, not shown, of the shaving apparatus is activated, thereby also activating the short-hair cutter K provided in the shaving head 2. During this process, the pinions 20 and 21 roll along the racks 22 and 23 of the switch slide 5 without the action of a force and without picking it up in the switching direction of the switch slide 4, this being due to the direction of rotation of the pinions 20 and 21 on the respective racks 22 and 23. The distance A between the stop 6 of the switch slide 4 and the stops 7.1 and 7.2 of the switch slide 5 is dimensioned such that, with the switch slide 4 in the switch position ST2, the stops 6 and 7.1, 7.2 are still slightly spaced apart and that abutment of the stop 6 with the stops 7.1 and 7.2 does not occur until after the switch slide 4 has overridden the switch position ST2, as shown in FIG. 3. Abutment of the stop 6 with the stops 7.1 and 7.2 causes the pinions 20 and 21 to be automatically locked on the racks 22 and 23. This locking action of the pinions 20 and 21 on the racks 22 and 23 is absolutely necessary to enable the pinions 20 and 21 to gear with the racks 29 and 30 as the switch slide 4 is further displaced beyond the distance C into the switch position ST3. Following engagement of the pinions 20 and 21 with the racks 29 and 30, the locked pinions 20 and 21 become unlocked automatically. As the switch slide 4 acting on the switch slide 5 is displaced further, the racks 29 and 30 cause the pinions 20 and 21 to roll along in reverse direction, as a result of which the switch slide 5 carrying the long-hair trimmer L is moved via the racks 22 and 23 away from the switch slide 4 in the direction of its operating position in which the long-hair trimmer L of the switch slide 5 then assumes the provided position in the area of the short-hair cutter K.

The length of travel of the switch slide 4 is limited on the one hand by abutment with the stop 11 provided on the housing 1 and on the other hand by abutment of the stops 31 and 32 provided on the switch slide 4 with the stops 24 and 25.

FIG. 3 shows a switch slide 4 in a position extended beyond the switch position ST2, that is, beyond the notch 14, with a stop 6 resting against the stops 7.1 and 7.2 and consequently locked pinions 20, 21 which are short of gearing with the racks 29 and 30. The stops 31 and 32 of the switch slide 4 are in an intermediate position relative to the stops 11 and the stops 24 and 25 of the housing 1. The locking cams 16 rest against the beveled walls of the switch coulisses 12 which in their capacity as notches 15 allow free displacement of the switch slide 4 up to its abutment with the stops 24 and 25. The pivoted spring 26, in exerting a low spring force, holds the switch slide 5 in abutment with the stops 24 and 25 and also holds the stops 7.1 and 7.2 of the switch slide 5 in abutment with the stop 6 of the switch slide 4.

By further displacement of the switch slide 4 in the direction of the stops 24 and 25 beyond the distance C, the first gear arrangement which is comprised of the pinions 20 and 21 rotatably mounted on the switch slide 4 and of the racks 22 and 23 provided on the switch slide 5 is brought into engagement with the racks 29 and 30 of the second gear arrangement, with the pinions 20 and 21 in locked condition. Following engagement with the pinions 20 and 21, the racks 29 and 30 cause a reversal of the direction of rotation, thus enabling the switch slide 4 to be displaced further until the stops 31 and 32 abut with the stops 24 and 25, as shown in FIG. 4. In the process, the pinions 20 and 21 roll along their respective racks 22, 30 and 23, 29, to the effect that the reversal of the direction of rotation of the pinions 20 and 21 produced by the racks 29 and 30 of the second gear arrangement moves the switch slide 5 via the racks 22 and 23 upwardly away from the switch slide 4 into the operating position. Based on the engagement of the pinions 20 and 21 with the racks 29 and 30, the switch slide 5 travels double the distance traveled by the switch slide 4 through the pinions 20 and 21 gearing with the racks 29 and 30 until abutment of the stops 31 and 32 with the stops 24 and 25.

Following engagement of the pinions 20 and 21 of the first gear arrangement with the racks 29 and 30 of the second gear arrangement, the switch slide 4 moves the switch slide 5 in the direction of its operating position via the pinions 20 and 21, with the spring 26 secured to the switch slide 5 and pivoted to the housing 1 performing a pivot movement causing the spring to be progressively tensioned. In the process, the switch slide 5 moves the spring 26 beyond the dead center T of its pivot arc SB, whereby the switch slide 5, by means of untensioning of the spring 26 as shown in FIG. 4, is moved on into the final operating position in which its long-hair trimmer L shown in FIG. 1 is operatively coupled to a drive not shown. In the process, the switch slide 5 automatically picks up the switch slide 4 via the pinions 20, 21 until its abutment with the stops 24 and 25. The final operating position, that is, the maximum extended position of the switch slide 5 carrying the long-hair trimmer L, is thus attained. As an alternative or addition, this position can also be determined by means of abutment of the switch slide 5 with stops 34 and 35 provided on the housing 1, as shown in FIG. 4. The abutment of the beveled corners of the switch slide 5 with the beveled abutment surfaces of the stops 34 and 35 results in a vibration-free location of the switch slide 5 in its operating position.

FIG. 5 shows the rear side 60 of the shaving apparatus of FIG. 1, with the rear panel partly broken away to illustrate the gear arrangements which are symmetrically disposed inside the housing 1. The housing 1 is, for example, double-walled comprising a housing frame and a case surrounding it. The side walls 27 and 28 of the housing frame provide each a stop 11 for the stops 114 of the switch slide 4 by means of which its OFF position ST1 is determined. Moreover, in the OFF position ST1, the resilient arms 17 molded into the side walls 27 and 28 of the housing frame have their locking cams 16 in engagement with the notches 13 provided on the switch coulisses 12 of the switch slide 4.

The switch slide 4 being of U-shape, it provides arms 18 and 19 having a respective pinion 20 and 21 rotatably mounted thereon.

Molded into the switch slide 4 are two grooves 36 and 37 the ends of which serve as stops 31 and 32. As the switch slide 4 is being displaced, the stops 31 and 32 move into abutment with the stops 24 and 25 formed on the housing, thus limiting, in cooperation with these stops, the contact travel of the switch slide 4.

In the switch position ST1 shown, the T-shaped switch slide 5 has its side arms 38 and 39 which extend transversely to its longitudinal extent, in abutment with the stops 24 and 25. Each side arm 38, 39 has a respective rack 22, 23 formed thereon which is in permanent engagement with the respective pinion 20, 21 provided on the switch slide 4. Two stops 7.1 and 7.2 are formed on the switch slide 5 at a predetermined relative distance A to the stop 6 which is provided by the end of the switch slide 4 intermediate the arms 18 and 19.

In the sliding direction of the two switch slides 4 and 5 when in the OFF position ST1, a respective rack 29, 30 is formed on the side walls 27, 28, with the rack teeth being arranged and aligned so as to gear with the pinions 20 and 21. In the embodiment of FIG. 5, the spring 26' is a leg spring whose arrangement and function will be explained in more detail in the following with reference to FIG. 6. At the end of the switch slide 5 remote from the side arms 38 and 39, the spring 26' rests with one leg end 40 against a bolt 41 provided on the switch slide 5 whilst its other leg end 42 rests against a bolt 43 provided on a transmission lever 44. At the ends of the transmission lever 44 respective bolts 45 and 46 are provided. The transmission lever 44 has its bolt 45 rotatably mounted in a recess 47 provided in the switch slide 5 while its bolt 46 engages into a coulisse 48 provided on the side wall 28 and allowing a rotational motion and a small sliding motion. The coulisse 48 is provided by two walls 49 and 50 formed on the side wall 28, with the wall 49 which is situated in the sliding direction of the switch slide 5 protruding relative to the wall 50. The shorter length of the wall 50 thus facilitates the introduction of the bolt 46 in the assembly of the transmission lever 44, whilst the longer length of the wall 49 prevents the bolt 46 and thus the transmission lever from disengaging from the coulisse 48 during displacement of the switch slide 5 into the dot-and-dash switch position which is the operating position of the switch slide 5 extended under the action of the spring 26'. As a result of the mounting of the spring 26' on both the transmission lever 44 and the switch slide 5, in combination with a mounting of the transmission lever 44 in the coulisse 48 so as to, allow a sliding motion, the forces of the spring 26' are not transmitted to the housing 1 or its side wall 28. Accordingly, movement of the switch slide 5 relative to the housing 1 into the operating position and back again is free from lateral forces. An angular tilt of the switch slide 5 relative to the housing is thus avoided.

In FIGS. 5, **5*a* and 6, the spring 26' with the transmission lever 44 and the switch slide 5 is shown in the OFF position ST1. As the switch slide 5 is moved into the operating position as illustrated and described with reference to FIGS. 2 to 4, which position is determined, for example, by abutment of the switch slide 5 with the stops 34 and 35 of the housing 1, the transmission lever 44 carried in the coulisse 48 performs a pivot movement in the course of which the spring 26' is progressively tensioned until dead center T is reached. The dead center T of the pivot arc SB described by transmission lever 44 and spring 26 is level with the coulisse 48. The switch slide 4 which, by means of abutment of the stop 6 with the stops 7.1 and 7.2 of the switch slide 5, causes the accordingly locked pinions 20 and 21 to gear with the racks 29 and 30, causes by means of further movement the switch slide 5 to extend, with the spring 26' and the transmission lever 44** being moved beyond the dead center T of the pivot arc SB.

Following overriding of dead center T, the spring 26' which then becomes untensioned automatically takes control of the further outward motion of the switch slide 5 into its operating position. The ensuing rolling movement of the pinions 20 and 21 upon the racks 23, 29, 22 and 30 with which they are in gear causes the switch slide 4 to be picked up until abutment of the stops 31 and 32 of the switch slide 4 with the stops 24 and 25 provided on the housing 1, without the user of the shaving apparatus being required to slide the switch slide 4.

For returning the switch slides 4 and 5 into the OFF position ST1, the switch slide 4 has to be displaced only until the switch slide 5 which is picked up via the pinions 20 and 21 has moved the pivoted spring 26' beyond the dead center T of its pivot arc SB. The, resulting untensioning of the spring 26' automatically returns the switch slides 4 and 5 to the OFF position ST1 in which the stops 7.1 and 7.2 are in abutment with the stop 6.

In FIG. **5*a* a further embodiment is shown in which the stops 31 and 32 of the switch slide 4 are formed by the ends of the arms 18 and 19. In this embodiment, the function of the two stops 24 and 25 provided on the housing 1 in the schematic representations of FIGS. 2 to 4 is performed by a total of four stops 24.1, 24.2, 25.1 and 25.2. The stops 24.1 and 25.1 serve for abutment of the switch slide 5 in the OFF position ST1 and are dimensioned such as to enable the switch slide 4 to be freely movable over these stops for the purpose of abutment with the stops 7.1 and 7.2 of the switch slide 5. The stops 24.2 and 25.2 are spaced from the ends of the arms 18 and 19, which ends serve as stops 31 and 32, at a distance corresponding to the length of travel of the switch slide 4, whereby the sequence of operations illustrated and described with reference to FIGS. 2 to 4** is also ensured in a structure and arrangement of the stops as embodied in this Figure.

List of References

| | |
|---|---|
| 1 Housing | 31 Stops |
| 2 Shaving Head | 32 Stops |
| 3 Front Panel of Housing | 33 Stop |
| 4 Switch Slide | 34 Stop |
| 5 Switch Slide | 35 Rear Side of Housing |
| 6 Stop | 36 Grooves |
| 7 Stop | 37 Grooves |
| 8 Stop | 38 Side Arm of 5 |
| 9 Stop | 39 Side Arm of 5 |
| 10 U-shaped Recess in Front Panel 3 | 40 End of Leg |
| | 41 Bolt |
| 11 Stop for 4 | 42 Leg End on 5 |
| 12 Two Switch Coulisses | 43 Bolt on 44 |
| 13 Notch | 44 Transmission Lever |
| 14 Notch | 45 Bolt |
| 15 Notch | 46 Bolt |
| 16 Locking Cams | 47 Recess |
| 17 Two Resilient Arms | 48 Coulisse |

-continued

| List of References | |
|---|---|
| 18 Arm | 49 Wall of 48 |
| 19 Arm | 50 Wall of 48 |
| 20 Pinion on 18 | 114 Stop |
| 21 Pinion on 19 | ST1 OFF Position |
| 22 Racks on 5 | ST2 ON Position |
| 23 Racks on 5 | ST3 Range of Operating Position for Switch Slide 5 |
| 24 Stop on 1 | |
| 25 Stop of 1 | |
| 26 Spring | SB Pivot Arc |
| 27 Side Wall of 1 | |
| 28 Side Wall of 1 | |
| 29 Rack | |
| 30 Rack | |

I claim:

1. A dry shaving apparatus comprising a housing, a short-hair cutter, a long-hair trimmer, a manually operated first switch slide slidably arranged on said housing for turning the dry shaving apparatus on and off, a second switch slide operatively associated with said first switch slide and carrying said long-hair trimmer which is movable by means of said second switch slide from a position of rest into an operating position lying in the area of said short-hair cutter and which in the operating position is coupled to the drive of the dry shaving apparatus, and first and second gear arrangements, one of said gear arrangements being provided for the travel of said first switch slide and another of said gear arrangements being provided for the travel of said second switch slide, said gear arrangements being interengageable in the course of the travel of said first switch slide.

2. A dry shaving apparatus as claimed in claim 1 wherein said first gear arrangement comprises at least one rack provided on said second switch slide and at least one pinion rotatably mounted on said first switch slide and permanently engaged with said rack.

3. A dry shaving apparatus as claimed in claim 1 wherein said second gear arrangement is comprised of at least one rack provided on said housing.

4. A dry shaving apparatus as claimed in claim 1 or claim 2 wherein said housing includes a stop for limiting the travel of said first switch slide.

5. A dry shaving apparatus as claimed in any one of claims 1–3 wherein said first switch slide includes a stop for limiting the travel of said first switch slide.

6. A dry shaving apparatus as claimed in any one of claims 1–3 wherein said housing and said first slide switch each includes a stop and in the OFF position of said first switch slide, said stop on said first switch slide, is in abutment with said stop on said housing.

7. A dry shaving apparatus as claimed in claim 1 or claim 2 and further including a pivotally arranged spring, and wherein said housing includes a stop, and said second switch slide is held in OFF position against said stop on the housing by means of said pivotally arranged spring.

8. A dry shaving apparatus as claimed in any one of claims 1–3 wherein said second switch slide includes at least one stop for abutment with said first switch slide.

9. A dry shaving apparatus as claimed in claim 2 wherein said first gear arrangement is adapted to engage with said second gear arrangement by means of displacement of said first switch slide picking up said second switch slide and by engagement of said pinion provided on said first switch slide with the teeth of said rack.

10. A dry shaving apparatus as claimed in claim 9 wherein said pinion is adapted to be stopped when a stop of said first switch slide engages a stop of said second switch.

11. A dry shaving apparatus as claimed in claim 9 or claim 10 wherein said second gear arrangement is comprised of at least one rack provided on said housing, and said pinion is adapted to thread into said rack on said housing.

12. A dry shaving apparatus as claimed in claim 1 wherein said first gear arrangement comprises at least one rack provided on said second switch slide and at least one pinion rotatably mounted on said first switch slide and permanently engaged with said one rack, said second gear arrangement is comprised of at least one rack provided on said housing, said gear arrangements when in mesh via said pinion and said racks reverse the direction of rotation of said pinion by means of which the further sliding travel of said second switch slide is adapted to be doubled relative to the travel of said first switch slide.

13. A dry shaving apparatus as claimed in any one of claims 1–3 wherein the sliding travel of said second switch slide is adapted to be limited by at least one stop provided on said housing.

14. A dry shaving apparatus as claimed in any one of claims 1–3 and further including a pivotally mounted spring, said spring being adapted to be moved by said first switch slide via said second switch slide into a pivot position overriding dead center (T) in which said second switch slide is movable into an operating position by means of releasing said spring which has become tensioned in the course of the pivot motion.

15. A dry shaving apparatus as claimed in claim 14 wherein said spring is a leg spring.

16. A dry shaving apparatus as claimed in claim 14 or claim 15 wherein said spring is mounted between two bolts, one bolt being provided on said second switch slide and the other bolt on a transmission lever that has one end carrier in a coulisse provided on said housing and its other end in a sliding bearing provided in said second switch slide.

17. A dry shaving apparatus as claimed in claim 1 wherein said switch positions (ST1, ST2, ST3) of said first switch slide are determined by engageable locking means provided on said first switch slide and on said housing.

18. A dry shaving apparatus as claimed in claim 17 wherein said locking means on said first switch slide includes a switch coulisse with a plurality of notches.

19. A dry shaving apparatus as claimed in claim 17 wherein said locking means on said housing includes a resilient arm with a locking cam.

20. A dry shaving apparatus as claimed in claim 17 wherein said first gear arrangement comprises at least one rack provided on said second switch slide and at least one pinion rotatably mounted on said first switch slide and permanently engaged with said one rack, and said second gear arrangement is comprised of at least one rack provided on said housing, said gear arrangements when in mesh via said pinion and said racks reverse the direction of rotation of said pinion by means of which the further sliding travel of said second switch slide is adapted to be doubled relative to the travel of said first switch slide.

21. A dry shaving apparatus as claimed in claim 20 and further including a pivotally mounted spring, and spring being adapted to be moved by said first switch slide via said second switch slide into a pivot position overriding dead center (T) in which said second switch slide is movable into an operating position by means of releasing said spring which has become tensioned in the course of the pivot motion.

* * * * *